US006293505B1

(12) United States Patent
Fan

(10) Patent No.: US 6,293,505 B1
(45) Date of Patent: Sep. 25, 2001

(54) WIDE OPENING LEAVES BAGGER

(76) Inventor: Jianhua Fan, 5800 Maudina Ave., Apt. C-2, Nashville, TN (US) 37309-3121

( * ) Notice: Subject to any disclaimer, the term of this patent is extended or adjusted under 35 U.S.C. 154(b) by 0 days.

(21) Appl. No.: 09/429,819

(22) Filed: Oct. 29, 1999

Related U.S. Application Data

(63) Continuation-in-part of application No. 09/074,829, filed on May 8, 1998, now Pat. No. 5,979,842.

(51) Int. Cl.[7] ..... B65B 67/04
(52) U.S. Cl. ..... 248/99; 141/391
(58) Field of Search ..... 248/95, 99, 97; 141/314, 391

(56) References Cited

U.S. PATENT DOCUMENTS 742,578 * 10/1903 Brown ..... 141/346
2,688,429 * 9/1954 Davison ..... 141/314
4,273,167 6/1981 Stillwell .
4,312,531 1/1982 Cross .
4,485,855 12/1984 Dillingham .
5,036,893 * 8/1991 DeCrane ..... 248/99 X
5,239,893 8/1991 DeCrane .
5,523,519 * 6/1996 Weber et al. ..... 141/314 X
5,868,364 * 2/1999 MacMillan ..... 248/97
6,116,549 * 9/2000 Santa Cruz et al. ..... 248/97

* cited by examiner

*Primary Examiner*—Ramon O. Ramirez

(57) ABSTRACT

A bagger apparatus includes a platform having an opening proximate a center of the platform and a bag holder being retained by the platform proximate the opening of the platform. In use, a bag having an opening is held by the bag holder. The opening of the bag is aligned to the opening of the platform. The platform has a wider area than the opening of the bag such that an object received by the platform can be led to the bag via the opening of the platform and the opening of the bag.

2 Claims, 8 Drawing Sheets

WIDE OPENING LEAVES BAGGER

RELATED PATENT APPLICATION

This application is a Continuation-In-Part application of U.S. patent application, Ser. No. 09/074,829, filed May 8, 1998, now U.S. Pat. No. 5,979,842.

FIELD OF THE INVENTION

The present invention relates to a bagger apparatus, and more particularly to a wide opening bagger apparatus.

BACKGROUND OF THE INVENTION

As it is well known, in autumn, people will sweep and move leaves from areas such as yard or public area. To bag leaves, some may use garbage cans to hold a bag, or even hold a bag by hand. It costs more time and labor to put leaves into the bag, because the opening of the bag is not wide enough. For this reason, some people use blanket, plastic film, even car cover to hold leaves and then move the leaves onto the truck or somewhere. Although it is easy to receive the leaves in this way, everytime the blanket, plastic film or the car cover cannot hold so many leaves as a trash bag, and the leaves in the blanket and the car cover need to be removed after filling everytime. Packing the leaves is also not an easy thing to do.

Therefore, it can be seen that there is a need for an improved bagger apparatus, particularly a wide opening leaves bagger to receive and move leaves in an easy way.

SUMMARY OF THE INVENTION

In order to overcome the above described considerations, a wide opening bagger apparatus is provided in this invention. The apparatus includes a platform to receive and lead the objects such as leaves into the bag. In addition, a normal trash bag can be used in the bagger apparatus to bag the leaves so that removal of the leaves-filled bag can be an easy thing.

In one embodiment in accordance with the principles of the present invention, a wide opening bagger apparatus is provided. The bagger apparatus comprises a standing member having a top opening and a plurality of members extending outwardly from the standing member; and a platform having an opening aligned with the top opening of the standing member, the platform being held by the plurality of members.

Still in one embodiment, the platform has a plurality of pieces hanging downwardly from the opening of the platform into the top opening of the standing member.

Further in one embodiment, the platform is flexible.

In another embodiment in accordance with the principles of the present invention, a wide opening bagger apparatus includes a platform having an opening proximate a center of the platform, the platform configured to be coupled to a bag such that the opening of the platform is aligned with an opening of the bag. The platform has a larger receiving area than the opening of the bag such that the platform receives and leads objects such as leaves into the bag.

Still in another embodiment, the coupling between the bag and the platform is via a bag holder. The bag holder is retained by the platform proximate the opening of the platform.

Further in another embodiment, the bag holder includes a first piece and a second piece, the first piece of the bag holder is mounted on the opening of the platform, and the second piece of the bag holder is mounted on the opening of the bag. The second piece detachably engages with the first piece.

Still in another embodiment, the platform has a plurality of pieces which are partially cut off from the platform so as to form the opening of the platform. The bag holder is retained by the plurality of pieces, and the bag is held onto the bag holder by clips or the like.

Further in another embodiment, the platform is flexible.

In another embodiment, the platform is supported by a standing frame. Alternatively, the platform can be used without a supporting frame.

Accordingly, the invention provides a new and improved bagger apparatus having a wide opening to receive the objects such as leaves.

Another advantage of one embodiment of the present invention is that it provides a simple structure to hold the opening of a bag.

A further advantage of one embodiment of the present invention is that the bagger apparatus can be easily assembled and disassembled.

A still further advantage of one embodiment of the present invention is that the flexible platform can be folded for easy storing.

It will be readily appreciated that additional advantages, which will become subsequently apparent, reside in the details of structure and operation of the invention as more fully hereinafter described and claimed.

DETAILED DESCRIPTION OF THE PREFERRED EMBODIMENT

The present invention is a wide opening bagger apparatus.

In the following description of the exemplary embodiment, reference is made to the accompanying drawings which form a part hereof, and in which is shown by way of illustration the specific embodiment in which the invention may be practiced. It is to be understood that other embodiments may be utilized as structural changes may be made without departing from the scope of the present invention.

One of the applications of the present invention is a leaves bagger.

Figure 1:
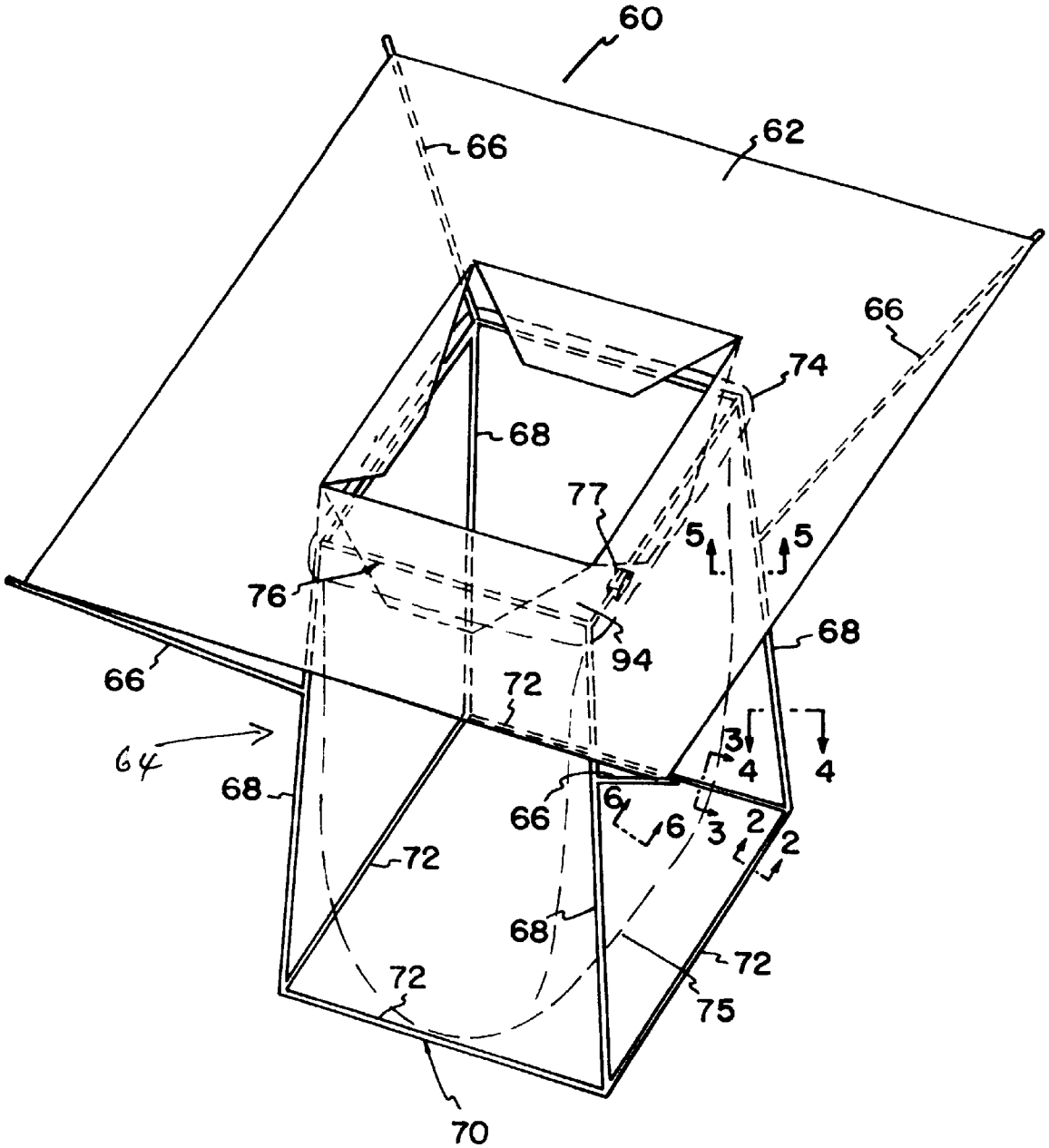
FIG. 1 is a perspective view of one embodiment of a bagger apparatus generally in accordance with the present invention.

One specific implementation of a leaves bagger 60 in accordance with the principles of the present invention is illustrated in FIGS. 1–8. Referring initially to FIG. 1, it is seen that the bagger 60 comprises a flexible platform 62 and a closed four-cornered frame 64 having four projecting frame members 66. Four frame members 72 form a square base 70, four legs 68 each of which has one end attached to the base 70 and the other end connected to a bag holder 76 which is in square. Four projecting frame members 66 extend from each leg 68 upwardly and outwardly, and the flexible platform 62 is then attached to the top of the projecting frame members 66. It is appreciated that the frame can be in any shape such as a circle shape. It is also appreciated that the material used for the frame 64 is not limited. The frame can be made of plastic pipes, metal pipes, or wood stakes, etc.

Figure 2:
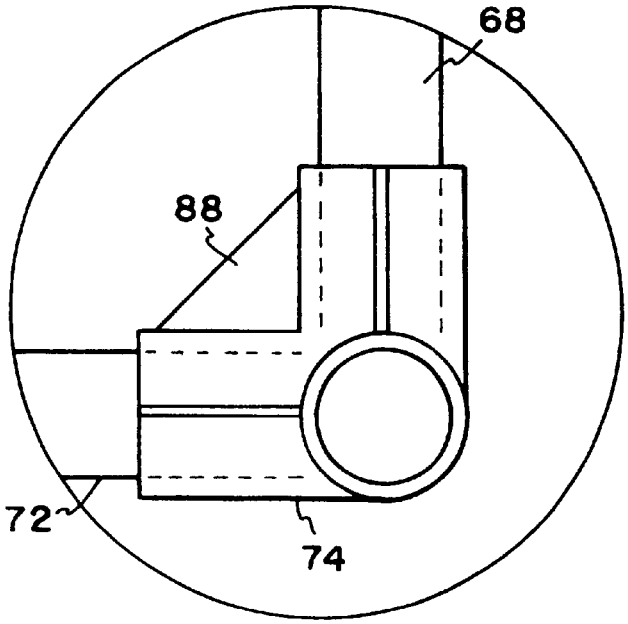
FIG. 2 is an enlarged view of a corner section of the bagger apparatus along line 2—2 of FIG. 1.
Figure 3:
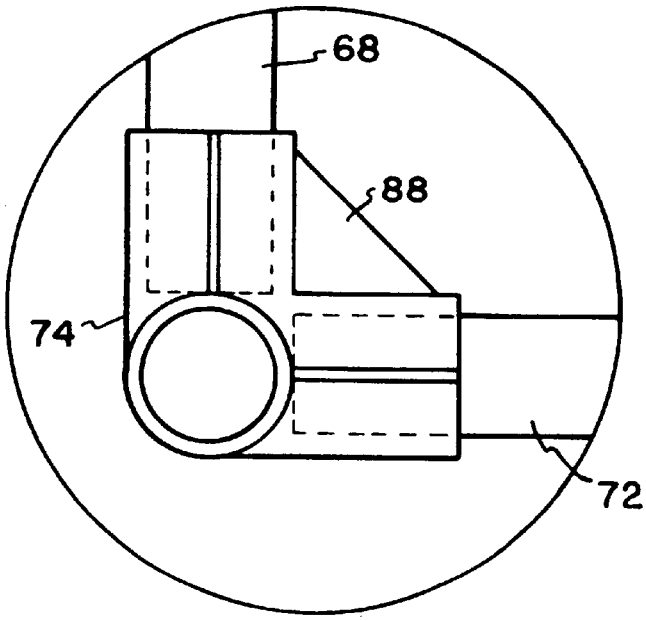
FIG. 3 is an enlarged view of the corner section of the bagger apparatus along line 3—3 of FIG. 1.
Figure 4:
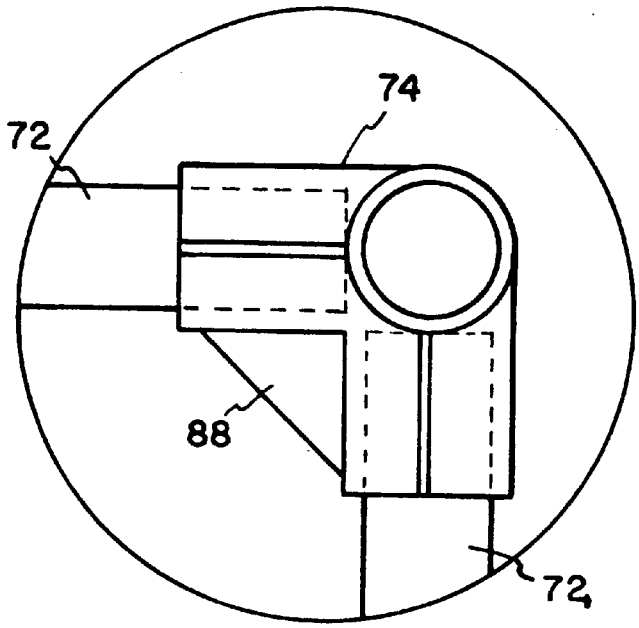
FIG. 4 is an enlarged view of the corner section of the bagger apparatus along line 4—4 of FIG. 1.

FIGS. 2, 3 and 4 show the enlarged views of a corner connector 74 of the frame 64 as shown in FIG. 1. The connector 74 connects the frame members 72 and the leg 68. A piece 88 (see FIGS. 2, 3, 4) may be disposed to integrally connect to the connector 74. It is noted that the same connector 74 can be provided to connect the bag holder 76 and the legs 68. In use, after placing a bag 75 into the frame 64, a top edge portion of the bag can be folded over the bag holder 76. A clip 77 or the like can be used to fix the bag to the frame 64 by attaching the top edge portion of the bag to the piece 88 or the other places on the frame 64, such as the bag holder 76 or the legs 68, etc.

Figure 5:
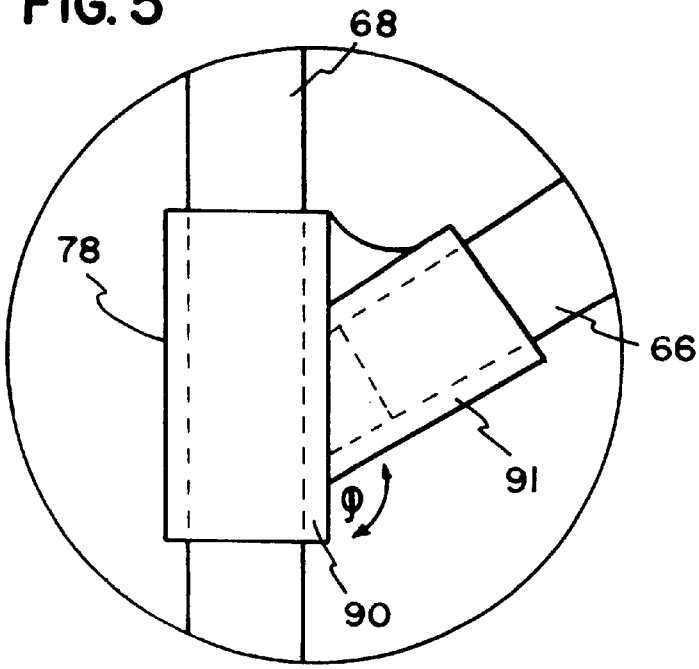
FIG. 5 is an enlarged view of an intersection along line 5—5 of FIG. 1.

FIG. 5 shows a connector 78 between the leg 68 and the projecting frame member 66. The connector 78 includes two integral pieces 90 and 91 with an angle $\phi$ therebetween. The projecting frame member 66 is inserted into the piece 91, and the leg 68 is insert into the piece 90. Preferably, the angle $\phi$ is between 120° and 135°. It is appreciated that other angles can be used within the scope of the invention.

Figure 6:
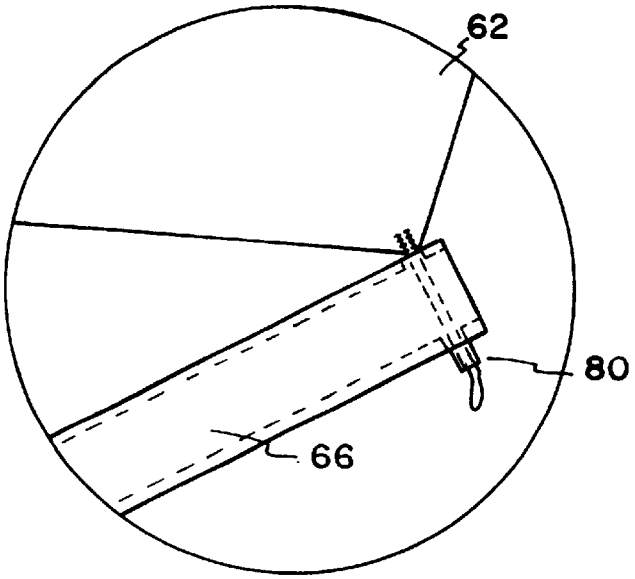
FIG. 6 is an enlarged view of a connection between a projecting member of the frame and a corner of platform along line 6—6 of FIG. 1.

FIG. 6 shows a fastener 80 between the flexible platform 62 and the projecting frame member 66. The fastener 80 fastens the corner of the flexible platform 62 and the top of the projecting frame member 66.

Figure 7:
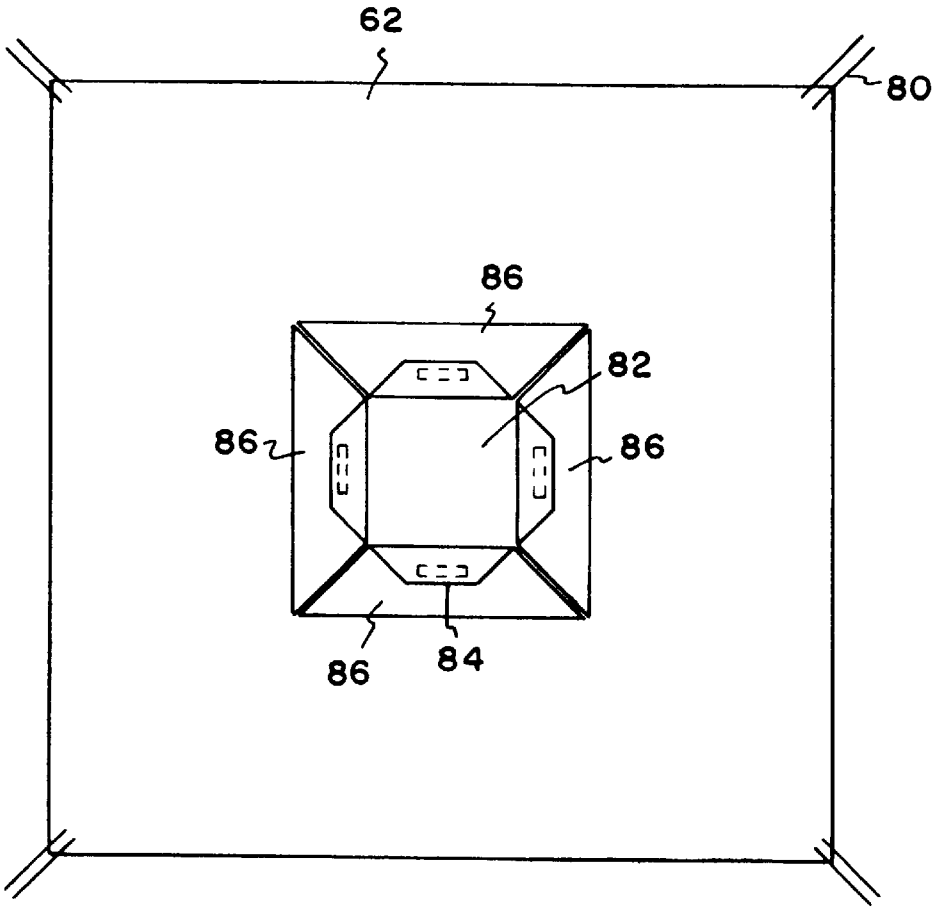
FIG. 7 is a top view of a flexible platform according to the present invention.

FIG. 7 shows a top view of the flexible platform 62. The flexible platform 62 has an opening 82 proximate the center of the platform 62. In one embodiment, the opening 82 can be made by cutting the center of the flexible platform 62 into four triangle shaped pieces 86. It is appreciated that other cutting shapes can be used within the scope of the invention.

Figure 8:
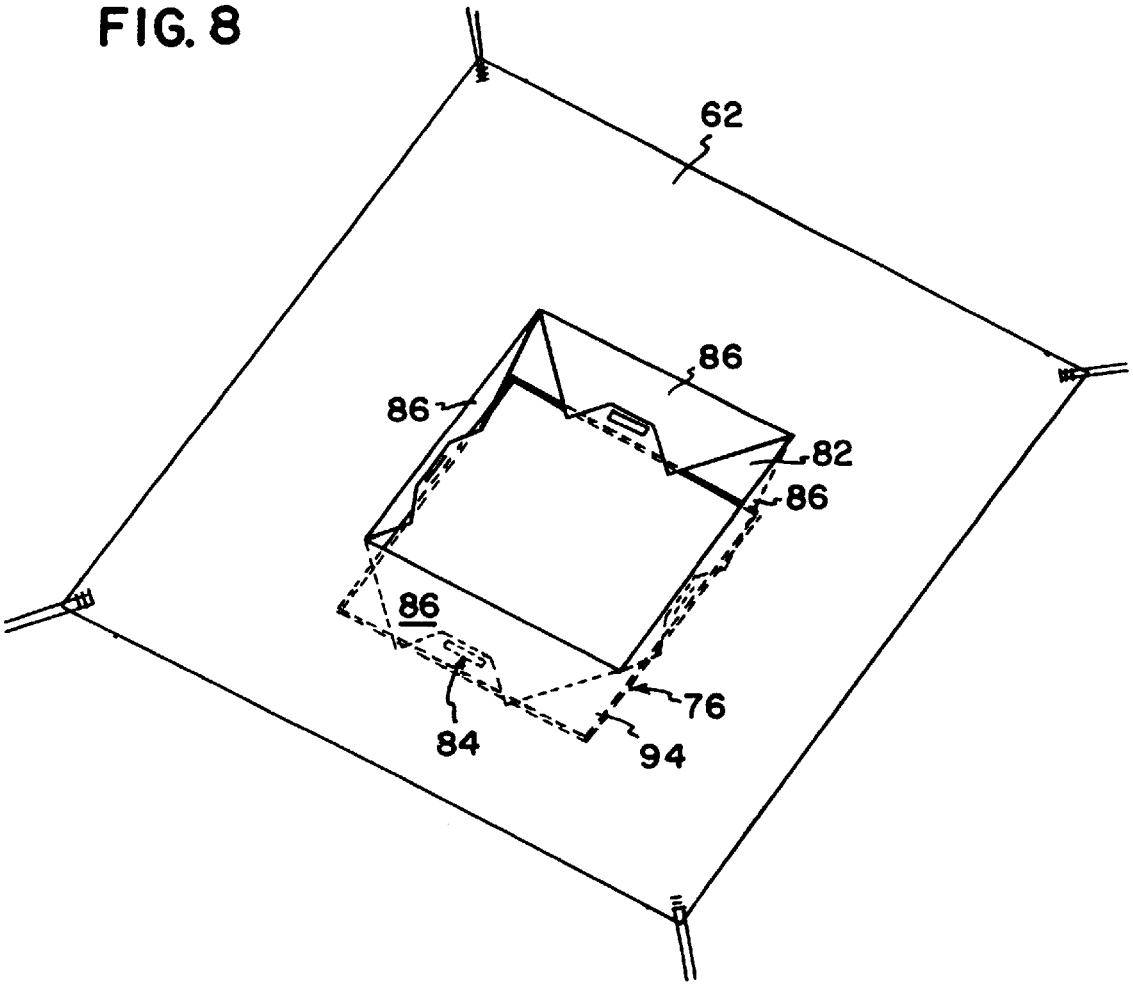
FIG. 8 is a perspective view of a flexible platform attached to a bag holder of the frame.

FIG. 8 shows that the four pieces 86 of the flexible platform 62 hang downwardly toward the bag holder 76 of the frame 64. The opening 82 is aligned with a top opening 94 (see also in FIG. 1) of the frame 64. In use, the triangle shaped pieces 86 are hung downwardly into the opening of the bag, thus objects, such as leaves, received by the flexible platform 62 can be led to the bag through the opening 82. The pieces 86 may include fasteners, such as valcro 84, to attach the pieces 86 to the bag holder 76.

The size of the frame 64 can be varied to meet different requirements. The size of the platform 62 can also be varied depending on the frame size and the angle between the leg 68 and the projecting frame member 66. For example, the length and width of the platform 62 can be 36 inches, and the length and width of the opening 82 can be 15 inches; the length and width of the frame 64 can be 18 inches, and the length of the leg 68 can be 24 inches. Because the frame members and the platform can be connected by the connector 74, 78 and the fastener 80, it is easy to assemble and disassemble the frame without any tools.

Figure 9:
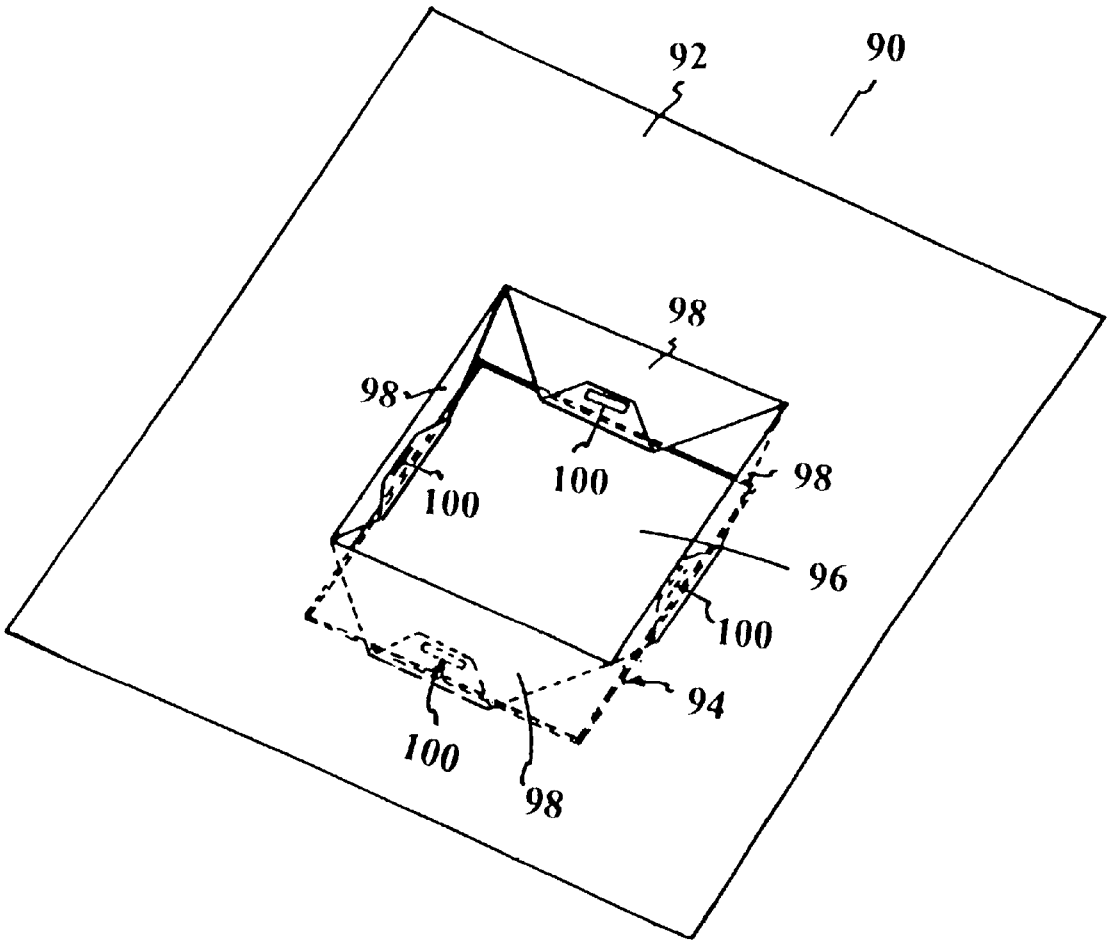
FIG. 9 is a perspective view of a second embodiment of a bagger apparatus having a platform conFigured to attach to a bag without a supporting frame in accordance with the principles of the present invention.

A second embodiment of a bagger apparatus 90 in accordance with the principles of the present invention is illustrated in FIG. 9. The bagger apparatus 90 includes a platform 92 and a bag holder 94. The platform 92 has an opening 96 proximate the center of the platform 92. The platform 92 can be made of metal, plastic, or flexible materials, such as cloth. Preferably, the platform 92 is flexible. In the preferred embodiment, the opening 96 can be made by cutting the center of the platform 92 into four triangle shaped pieces 98. It is appreciated that other cutting shapes can be used within the scope of the invention. Also, it would be appreciated by a person skilled in the art that a hanging piece hung downwardly from the platform 92 can be used within the scope of the present invention. The cut opening 96 of the platform 92 can be in a square shape. The bag holder 94 can be in a square shaped frame. The four pieces 98 of the platform 92 hang downwardly toward the bag holder 94 and looped around the four edges of the bag holder 94. It is appreciated that the bag holder 94 and the cut opening 96 can be in any other suitable shape, such as a round shape. The pieces 98 have fasteners, such as valcro 100, to retain the bag holder 94. In use, a bag which can be similar to the bag 75 shown in FIG. 1, can be retained onto the bag holder 94 by fasteners, such as clips, valcro etc., at the edges or corners of the bag holder 94. Accordingly, the opening of the bag is aligned with the opening 94 of the platform 92. Objects such as leaves or the like received by the platform 92 can be led to the bag through the opening 96. The platform 92 can be placed on ground initially and lifted up to lead the leaves or the like to the bag.

Figure 10:
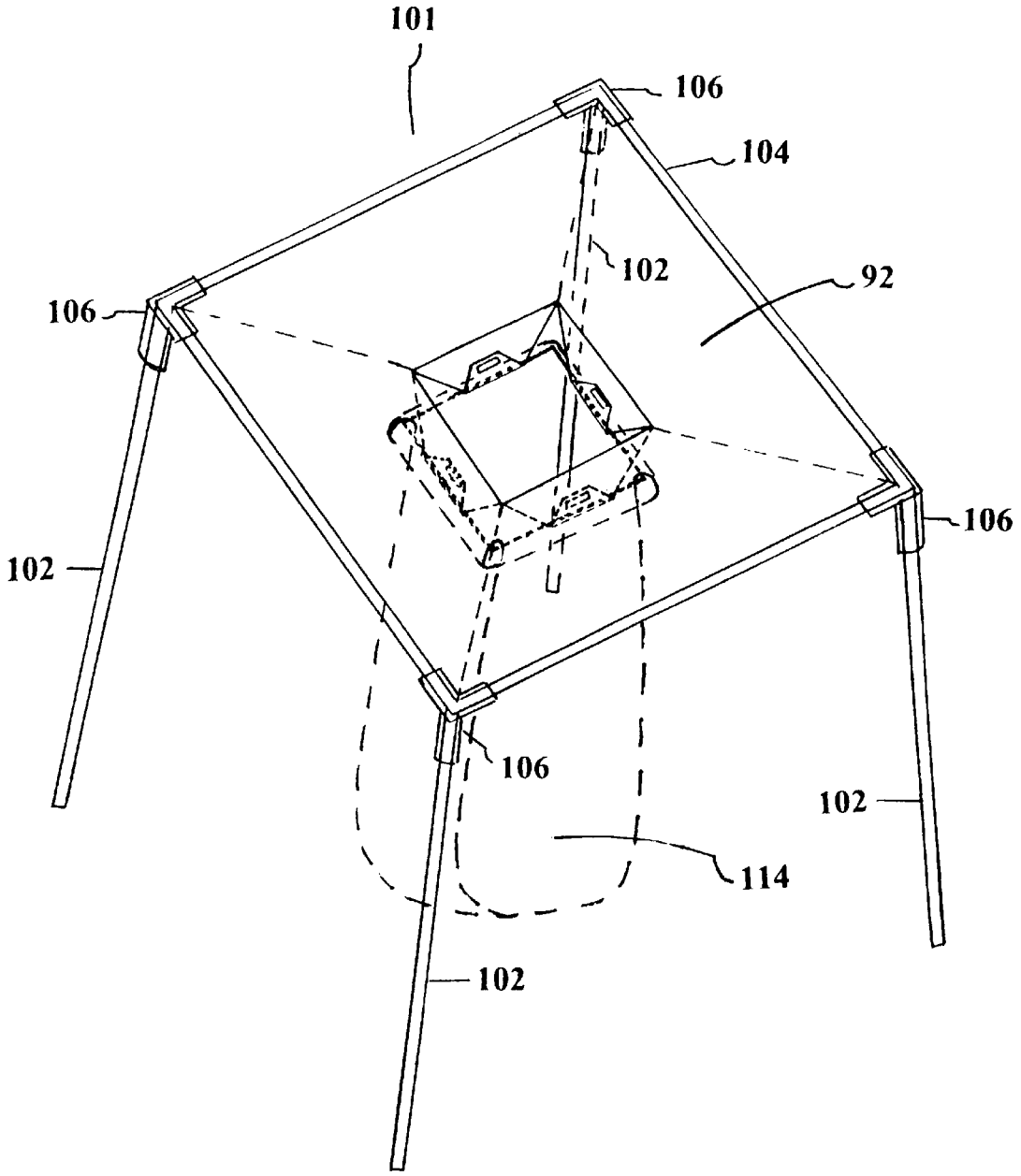
FIG. 10 is a perspective view of a third embodiment of the bagger apparatus having a platform supported by a frame in accordance with the principles of the present invention.

In another embodiment of a bagger apparatus 101 is shown in FIG. 10. In FIG. 10, the platform 92 of FIG. 9 is supported by legs 102 and a top frame 104. The legs 102 and the top frame 104 are attached to each other via connectors 106. The connectors 106 can be corner connectors which may be similar to the corner connectors 74 shown in FIG. 2. It is appreciated that other types of corner connectors can be used within the scope of the invention.

As shown in FIG. 10, the platform 92 is secured to the top frame 104. The platform 92 can be secured to the top frame 104 in a variety of ways. For example, the platform 92 can be sewed onto itself with stitches by looping around the edges of the top frame 104, etc. Further, the legs 102 can be a telescopic design so that they can be adjusted depending on the height of the bag.

Figure 11:
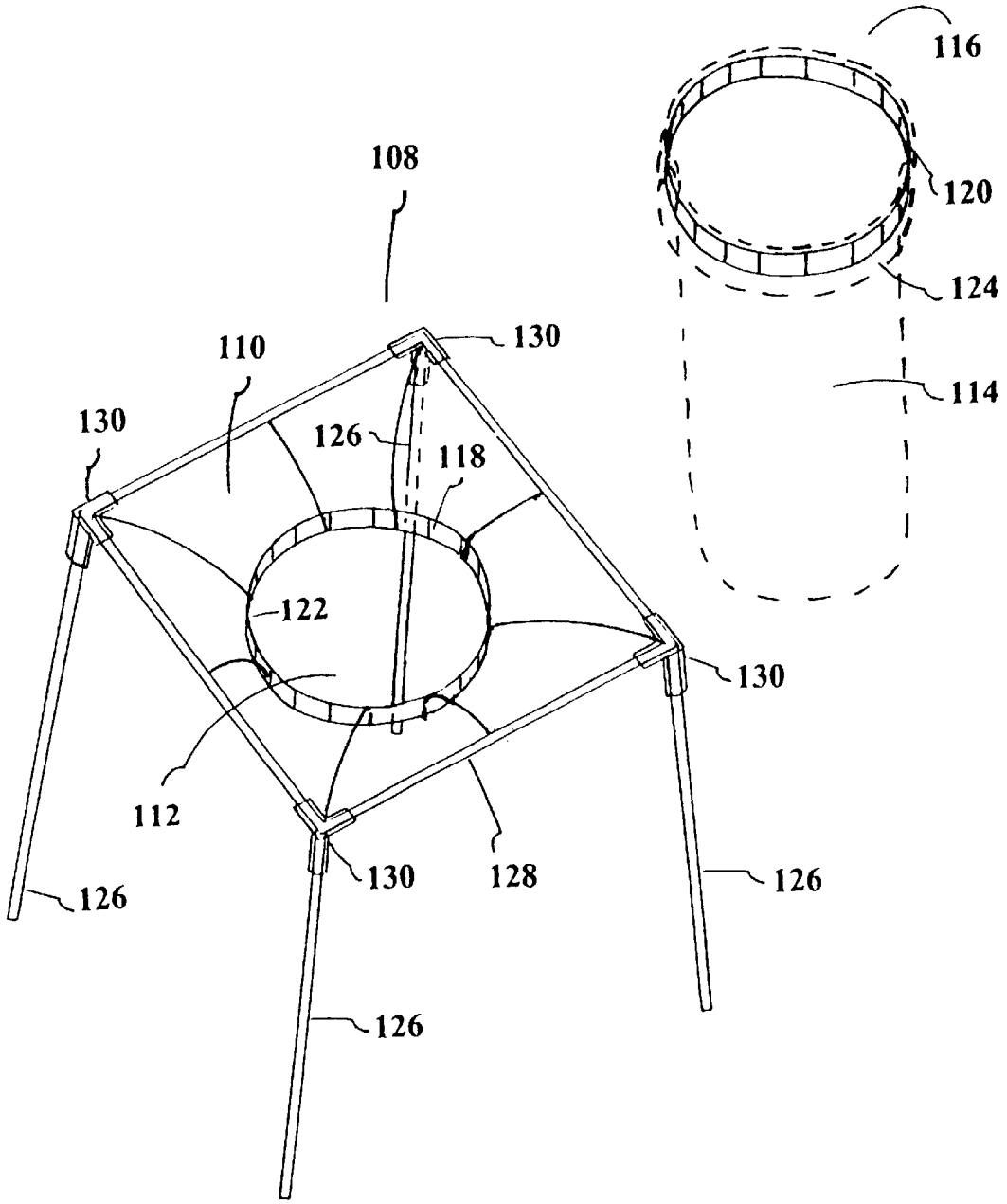
FIG. 11 is a perspective view of a fourth embodiment of the bagger apparatus having a platform conFigured to attach to a bag via a bag holder in accordance with the principles of the present invention.

FIG. 11 illustrates another embodiment of a bagger apparatus 108 in accordance with the principles of the present invention. The apparatus 108 includes a flexible platform 110 having an opening 112 proximate the center of the platform 110. The platform 110 is coupled to a bag 114 via a bag holder 116. The bag holder 116 may include two pieces 118 and 120. The piece 118 is retained at an opening edge 122 of the platform 110. The other piece 120 is retained at an opening edge 124 of the bag 114. The bag 114 can be attached to the piece 120 in a variety of ways. In one embodiment, the opening edge 124 of the bag 114 is looped around the piece 120 and retained thereto by stitches, clips, or the like. The platform 110 can be attached to the piece 118 in a variety of ways. In one embodiment, the opening edge 122 of the platform 110 is looped around the piece 120 and retained thereto by stitches, clips, or the like.

Also as shown in FIG. 11, the piece 120 may include a couple of hooks so as to hook the piece 120 onto the piece 118. Once the two pieces are hooked together, the top opening of the bag 114 and the opening 112 of the platform 110 are aligned to each other. It is appreciated that other types of attachment between the bag 114 and the platform 110 can be used without departing from the principles of the present invention.

Also in FIG. 1, legs 126, a top frame 128, and connectors 130 may be similar to those described in FIG. 10 to support the platform 110. It would be appreciated to a person skilled in the art that the top frame, legs, and connectors can be replaced by a suitable single frame to support the platform 110.

It is appreciated that many other suitable implementation can be used within the principles of the present invention generally shown above. The foregoing description of the exemplary embodiment of the invention has been presented for the purpose of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A bagger apparatus comprising:

a platform, the platform having an opening proximate its center, a plurality of pieces hanging downwardly from the opening edge;

a bag holder, the bag holder being retained by said plurality of pieces hanging downwardly from the opening edge;

a frame, the frame having a top and a plurality of legs, the legs support the top, the top hold the platform; and a container, having an opening, the container being held by the bag holder and its opening being aligned to the opening of the platform, wherein the platform has a wider area than the opening of the container such that an object received by the platform can be led to the container via opening of the platform and the opening of the container.

2. The apparatus as claimed in claim 1, further comprising a second holder, the second holder hold the container at the opening edge, wherein the second holder with the container is being held by the bag holder.

* * * * *